United States Patent [19]

Boyles

[11] Patent Number: 4,488,371

[45] Date of Patent: Dec. 18, 1984

[54] HOLD DOWN LATCH APPARATUS

[76] Inventor: Edward K. Boyles, 3528 W. 185th St., Torrance, Calif. 90504

[21] Appl. No.: 425,221

[22] Filed: Sep. 28, 1982

[51] Int. Cl.[3] ..... F41C 27/00

[52] U.S. Cl. ..... 42/90

[58] Field of Search ..... 42/90, 87, 50, 7

[56] References Cited

U.S. PATENT DOCUMENTS

| | | | |
|---|---|---|---|
| 1,245,499 | 11/1917 | Orme | 42/7 |
| 2,137,491 | 11/1938 | Huff | 42/90 |
| 2,514,277 | 7/1950 | Donnallan | 42/90 |
| 2,862,324 | 12/1958 | Ball | 42/50 |
| 2,864,193 | 12/1958 | Drew | 42/87 |
| 2,885,811 | 5/1959 | Womble, Jr. | 42/50 |
| 3,509,655 | 5/1970 | Wilhelm | 42/87 |
| 4,050,175 | 9/1977 | Mulinix | 42/90 |
| 4,334,376 | 6/1982 | Winslow | 42/90 |

*Primary Examiner*—Charles T. Jordan

*Attorney, Agent, or Firm*—Roger A. Marrs

[57] ABSTRACT

A hold down latch is disclosed herein for relieving spring tension or pressure from a follower slidable in a passageway or cavity of a magazine intended to be loaded with ammunition. The latch includes an elongated body having a recess open at one end and open along one side of the body so as to define a base at one end and a back member on one side with parallel spaced apart panels interconnecting the base and back member to complete the recess. A selected one of the panels is provided with a hook adjacent to the open end of the recess adapted to insertably receive a button carried on the spring tension follower of the magazine. The back member includes an arcuate thumb surface extending across the panels adjacent the open end and a hole is provided in the panel having the hook for receiving a retainer tool.

1 Claim, 4 Drawing Figures

FIG. 1
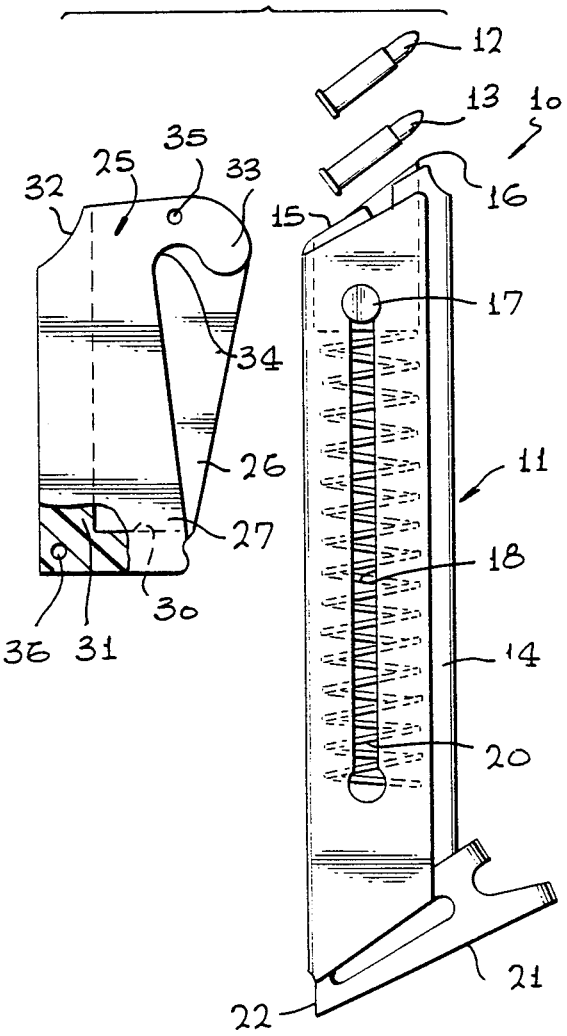
FIG. 2
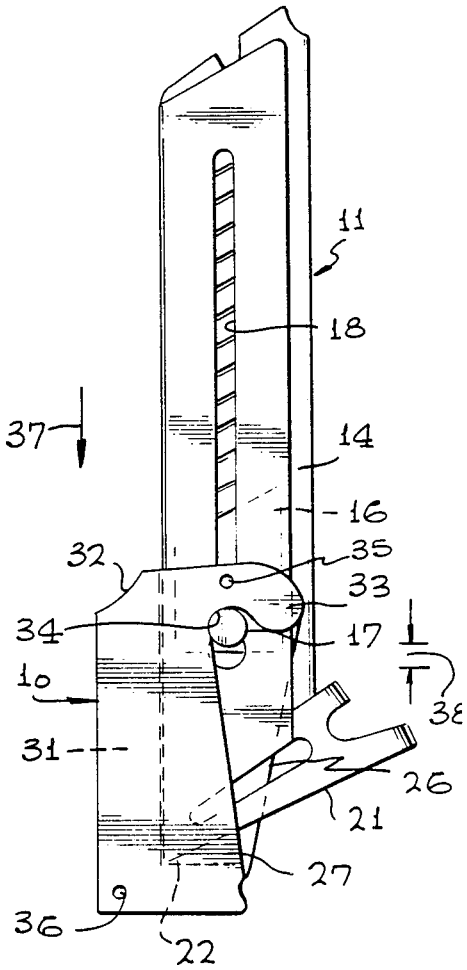
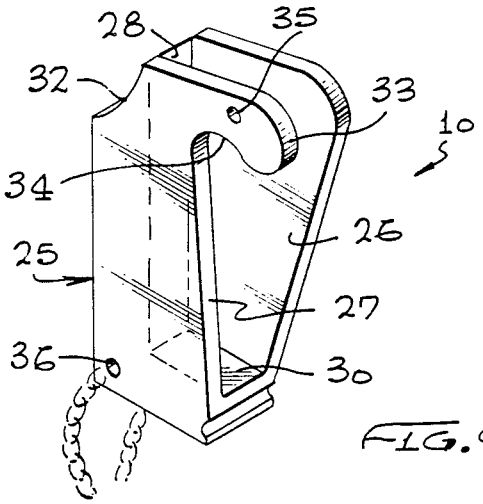
FIG. 4
FIG. 3
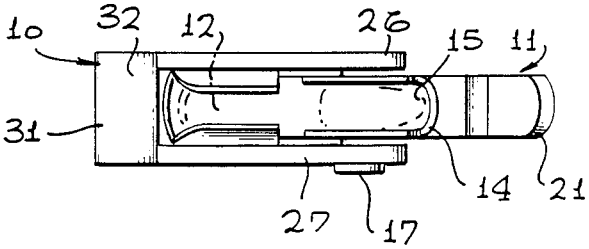

HOLD DOWN LATCH APPARATUS

BACKGROUND OF THE INVENTION

1. Field of the Invention

The present invention relates to hold down mechanisms and more particularly to a novel hold down latch apparatus for relieving spring tension or pressure from a follower utilized in an ammunition magazine during an ammunition loading procedure so that the user's hands are free to perform the loading operation.

2. Brief Description of the Prior Art

It has been a conventional practice in the arms field to load a plurality of individual bullets into a receiving cavity provided in a magazine which is subsequently put into a firearm intended to be fired. A conventional magazine employs a hollow housing having a follower slidably disposed therein which is normally biased towards an open end by an expanding spring. A slot in the side of the housing accommodates passage of a button fastened to the follower so that the user may depress the follower against the spring bias by placing his thumb on the button and manually forcing the follower against the spring tension. An alternate procedure would be to introduce the ammunition one bullet at a time through the recess into contact with the follower and force the follower against the bias of the spring. In actual practice, a combination of the two above procedures is generally employed.

Difficulties and problems arise when performing a loading operation which stem largely from the fact that the user's thumb is forced against the button which causes discomfort and, in some instances, a sensation of pain as the button is forced against the tension of the spring biasing the follower.

Furthermore, it is sometimes necessary for cleaning and maintenance purposes to remove the button from the follower and such a procedure is awkward to perform where the follower is encased by the housing and limited access is gained to the follower for hold down purposes.

Therefore, a long standing need has existed to provide a hold down mechanism for restraining the spring loaded follower in a position so that ammunition may be readily loaded into the magazine without the necessity of the user employing his thumb for forcibly urging the buttoned follower against its spring tension.

SUMMARY OF THE INVENTION

Accordingly, the above problems and difficulties are obviated by the present invention which provide a novel hold down mechanism or latch comprising an elongated body having a recess for slidably receiving an ammunition magazine and which includes a hook means for insertably receiving a button follower so that the follower may be moved against a spring tension. The device includes a latch means for receiving the heel of the ammunition magazine whereby the button follower can be maintained in a compressed position to permit a full loading of the magazine. Also, means are provided for receiving a hold down tool for service and maintenance purposes in order to remove the button from the follower.

Therefore, it is among the primary objects of the present invention to provide a novel hold down latch apparatus for activating a button follower on an ammunition magazine so that the user does not have to engage the button with his thumb or hand.

Another obJect of the present invention is to provide a novel hold down latch which is convenient to use, economical to manufacture and which requires little installation or assembly with an ammunition magazine in order to actuate the ammunition follower.

Still a further object of the present invention is to provide a hold down latch which is of one piece construction and that employs a simple hook means for actuating the button follower of an ammunition magazine.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

FIG. 1 is an exploded view showing the novel hold down latch apparatus of the present invention preparatory for installation on a conventional ammunition magazine;

FIG. 2 is a side elevational view of the hold down latch apparatus shown in FIG. 1 in full engagement and assembly with the ammunition magazine;

FIG. 3 is a top plan view of the hold down apparatus and ammunition magazine as shown in FIG. 2; and FIG. 4 is a perspective view of the novel apparatus shown in FIGS. 1–3 inclusive.

DESCRIPTION OF THE PREFERRED EMBODIMENT

Referring to FIG. 1, the novel hold down apparatus of the present invention is illustrated in the general direction of arrow 10 which is used in conjunction with an ammunition magazine 11 which is employed for storing a plurality of bullets such as bullets 12 and 13. The ammunition is stored in the interior of a housing 14 having an elongated opening 15 leading into the interior of the housing for receiving the individual bullets. Slidably carried within the housing is a follower identified by numeral 16 which carries a button 17 outwardly projecting from its side through a slot 18. The opposite ends of the slot serve as limit stops for preventing the follower 16 going beyond these points. A compression spring 20 is employed for normally biasing the follower 16 into the opening 15. The spring 20 expands within the interior of the housing 14 and may be compressed by the user placing his thumb against the button 17 and forcing the follower down against the bias of the spring 20. Once the follower 16 has been moved through the housing 14 against the tension of the spring 20, storage space is available in the magazine for receiving the bullets one by one through the opening 15. Once the magazine has been loaded, the spring 20 will urge the follower 16 against the stack of bullets and the uppermost bullet in the stack will be fed into the breach of the gun into which the magazine is loaded.

Also, the ammunition magazine 11 is provided with a clip portion 21 having a corner or heel section 22 adapted to be snapped into a receiver in the firearm into which the ammunition magazine is being installed. Inasmuch as the ammunition magazine 11 including the clip 21 is of conventional design, it is not believed necessary to amplify the construction further.

The hold down device 10 is employed for assisting the user in depressing the button 17 and the follower 16 against the expansion pressure of the spring 20. The hold down device 10 includes an elongated body 25 having a panel 26 and a panel 27 separated by an L-shaped spacer broadly indicated by numeral 28.

As shown more clearly in FIG. 4, the device includes an elongated recess defined between the opposing surfaces of panels 26 and 27 as well as a foot portion 30 of the spacer 28 and a back member 31 of the spacer 28.

The top of the back member 31 and the adjacent respective ends of the panels 26 and 27 are champered to provide a thumb recess 32 so that the user may place his thumb against the recessed surface when forcing the follower or slider 16 against the tension of the spring 20. A major feature of the invention resides in the provision of a hook 33 having an indentation or small slot 34 adapted to engage with the pin 17 when the device 10 has been installed on the magazine 11. Also, a hole 35 is provided in the top of the panel 27 adjacent to the hook 33 wherein a holding tool can be inserted, as will be explained later, when it is desired to remove the pin 17 for maintenance and repair of the magazine. Another hole 36 may be provided through the spacer 28 through which a chain, string or the like may be drawn when the device is used for a key ring or similar accessory article.

Referring now in detail to FIG. 2, it can be seen that when the side of the housing 14 of the magazine 11 is placed within the recess defined between the panels 26 and 27 and when the aperture or opening 34 is occupied by the pin 17 within the hook 33, the device 10 may be moved in the direction of arrow 37 which causes the follower 16 to press against the tension or expansion of the spring 20. By engaging the heel of the magazine with the juncture of the back piece 31 with the base 30 of the spacer 28, the user may take his hand away from the device and loading of the magazine with bullets can proceed without the user having to maintain thumb pressure on the pin 17. As illustrated, a stack of bullets has been introduced into the interior of the magazine and rests on top of the follower or slider 16 which is retained in position by means of the spring 20 pressing the pin 17 against the hook 33 while the heel 22 of the magazine bears against the base 30. A slight gap is indicated by numeral 38 which is present between the underside of the pin 17 and the extreme lower end of the slot 18. When it is desired to remove the pin from its installation in the follower, the pin 17 is forced further through the slot to the very end by manual thumb pressure and a holding tool such as a nail or the like is introduced through the opening 35 and passed through the slot 18 above the top edge of the follower 16. At this time, the pin 17 is released and the top of the follower is forced against the pin introduced through the aperture 35 by the expanding force of the spring 20. The nail or holding tool maintains the follower in position so it will not ride upwardly under the pressure of spring 20.

In view of the foregoing, it can be seen that the novel hold down device of the present inventions provides a novel means for manually pulling the follower 16 downwardly by means of the pin 17 against the tension of the spring 20 to the limit of the cavity or hollow in the housing 14 and then the hold down retains the follower in position so that the bullets can be loaded through the opening 15. Initially, the magazine and hold down device are shown as in FIG. 1. The top end of the magazine is introduced into the recess between the adjacent surfaces of the panels 26 and 27 and the device 10 is slightly tilted or cocked so that the pin 17 can be introduced into the opening 34 behind the hook 33 formed in the panel 27. Once in this position, the user's thumb is placed against the champered surface 32 and manual pressure is exerterted downwardly on the device 10 against the tension of the spring 20. As the expanding force of the spring is overcome, the follower 16 will proceed downwardly in the hollow of the housing 14 until the heel 22 of the housing can be snapped into the recess between panels 26 and 27 into the position shown in FIG. 2. Now bullets can be introduced through opening 15 to completely load the magazine. Once loaded, the device 10 is forced downward approximately the distance shown by gap 38 so as to release the heel 22 from the device by slightly pivoting the device in a clockwise direction around the pin 17. The device can now be removed from the pin and the housing and the magazine is ready for use.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

I claim:

1. A hold down latch apparatus comprising:

an L-shaped body having a top and opposite sides;

a panel carried on opposite sides of said body open at the top and side whereby a recess is defined between the opposing wall surfaces of said panels;

a portion of selected one of a said panels being cutaway to provide an open hook adjacent the open top and open side of said recess;

said L-shaped body having a champered corner at the top opposite from said hook;

said side panels include edges on each side that are angularly disposed on the opposite side with respect to each other in spaced relationship whereby said edges converge together defining an entrance leading into said recess;

said L-shaped base includes a base member along the bottom and an upright back member normal to said base member wherein the interior common surfaces of said members define the back and bottom of said recess opposite to said entrance side and top thereof;

said panel having said hook is provided with an aperture immediately above said hook;

a hole provided in said base member for insertably receiving an attachment chain means; and said L-shaped base member being provided with an arcuate thumb recess opposite from said hook constituting said champered corner.

* * * * *